US007837047B2

(12) United States Patent
Krause

(10) Patent No.: US 7,837,047 B2
(45) Date of Patent: Nov. 23, 2010

(54) JOINT ARRANGEMENT

(75) Inventor: Rainer Krause, Isernhagen (DE)

(73) Assignee: Voith Torbo Scharfenberg GmbH & Co. KG (DE)

( * ) Notice: Subject to any disclaimer, the term of this patent is extended or adjusted under 35 U.S.C. 154(b) by 258 days.

(21) Appl. No.: 12/084,079

(22) PCT Filed: Oct. 9, 2006

(86) PCT No.: PCT/EP2006/009740

§ 371 (c)(1),
(2), (4) Date: Apr. 24, 2008

(87) PCT Pub. No.: WO2007/057074

PCT Pub. Date: May 24, 2007

(65) Prior Publication Data

US 2009/0039044 A1 Feb. 12, 2009

(30) Foreign Application Priority Data

Nov. 15, 2005 (EP) ..... 05024943

(51) Int. Cl.
*B61G 9/04* (2006.01)
*B61G 9/22* (2006.01)

(52) U.S. Cl. ..... 213/64; 213/45; 213/46 A; 213/46 R

(58) Field of Classification Search ..... 213/7, 213/12–14, 40 R, 44, 45, 46 A, 46 R, 64; 267/3

See application file for complete search history.

(56) References Cited

U.S. PATENT DOCUMENTS 606,105 A * 6/1898 Van Dorn ..... 213/12
4,136,787 A * 1/1979 Forster et al. ..... 213/40 R

FOREIGN PATENT DOCUMENTS

DE 3421166 A1 6/1985
DE 20009859 U1 10/2001
EP 1342637 9/2003

* cited by examiner

*Primary Examiner*—S. Joseph Morano
*Assistant Examiner*—Zachary Kuhfuss
(74) *Attorney, Agent, or Firm*—Cesari and McKenna, LLP; Patricia A. Sheehan

(57) ABSTRACT

A joint arrangement for connecting a drawbar to a carriage includes a push/pull device for the transmission of pushing and pulling forces arranged at the carriage end of the drawbar. The push/pull device comprises a mid-piece connected to the carriage side end of the drawbar, extending the drawbar in the longitudinal direction thereof which extends through an opening provided in the baseplate. A front spring plate and a rear spring plate are provided on the mid-piece with a front spring element between the front spring plate and the baseplate in the drawbar longitudinal direction and a corresponding rear spring element is provided between the baseplate and the rear spring plate. The front spring element and the rear spring element enclose the mid-piece of the push/pull device with a positive fit in order to guide and support the mid-piece of the push/pull device in the most effective manner possible within the baseplate and are themselves supported in the vertical direction on the baseplate and in particular on a recess region provided in the baseplate.

18 Claims, 7 Drawing Sheets

JOINT ARRANGEMENT

BACKGROUND OF THE INVENTION

This invention relates to a joint arrangement for linking a draw bar to a coach body, comprising draw/buffing gear arranged at the coach body end of the draw bar for transmitting tractive and impact forces acting on the draw bar to a base plate connected to the coach body, the draw/buffing gear having a centre piece connected to the coach body end of the draw bar and extending the draw bar in its longitudinal direction, the said centre piece extending through an inlet opening provided in the base plate and having a front spring plate on the draw bar side and a rear spring plate on the coach body side, and the draw/buffing gear further having at least one front spring element of resilient material arranged between the front spring plate and the base plate in the longitudinal direction of the draw bar and at least one rear spring element of resilient material arranged between the base plate and the rear spring plate in the longitudinal direction of the draw bar in order to absorb the tractive and impact forces to be transmitted.

The publication DE 200 09 859 U1 discloses a joint arrangement for linking a draw bar to a coach body, this joint arrangement known from the prior art including draw/buffing gear (resilient elements) arranged at the coach body end of the draw bar for transmitting tractive and impact forces acting on the draw bar. A centre piece extending the draw bar in its longitudinal direction is furthermore provided, the said centre piece extending through an inlet opening provided in a base plate and having a front spring plate on the draw bar side and a rear spring plate on the coach body side. A front spring element arranged between the front spring plate and the base plate in the longitudinal direction of the draw bar and a rear spring element arranged between the base plate and the rear spring plate in the longitudinal direction of the draw bar are furthermore to be provided in order to absorb the tractive and impact forces to be transmitted.

The publication EP 1 342 637 A1 discloses a joint arrangement similar to the arrangement known from the prior art according to the publication DE 200 09 859 U1 from a functional and a structural point of view, although the aim of the publication EP 1 342 637 A1 is to provide a joint arrangement with a lightweight construction which is supposed to be designed so as to transmit the longitudinal compressive forces occurring during shunting operations in a reliable manner. Special intermediate plates are provided to this end between the front spring element and the base plate in this arrangement, their shape at the coach body side being such that they can effect support in the vertical and in the horizontal direction against an inlet opening provided in the base plate.

A joint arrangement of the type mentioned at the outset is known e.g. from railway engineering, where it is generally used in couplings and joints for interconnecting coach bodies or complete trains by means of automatic couplings or tight couplings.

For an illustration of the basic design of a joint arrangement of this kind, reference should be made to FIG. 1*a*, showing a joint arrangement of the type mentioned at the outset known from the prior art. FIG. 1*b* shows the joint arrangement according to FIG. 1*a* in a state of compression, i.e. in a state in which compressive forces act on the draw bar and are absorbed by means of the draw/buffing gear integrated into the joint arrangement and are then transmitted to the associated coach body.

The draw/buffing gear 100 integrated into the joint arrangement shown in FIG. 1*a* has a total of three annular rubber springs serving as spring elements 116, 117, two of the three spring elements 116 being arranged between a front spring plate 114 on the draw bar side and a base plate 111 connected to the coach body (not explicitly shown). Another elastomeric spring element 117 is arranged between the base plate 111 and a rear spring plate 115 on the coach body side. In the non-stressed state of the joint arrangement shown in FIG. 1*a*, the two front spring elements 116 are pretensioned between the front spring plate 114 and the base plate 111 and the rear spring element 117 is pretensioned between the base plate 111 and the rear spring plate 115. In particular, the draw/buffing gear 100 integrated into the joint arrangement shown in FIG. 1*a* and known from the prior art has a centre piece 12 connected to the coach body end of the draw bar 2 and extending the draw bar 2 in its longitudinal direction, the said centre piece extending through an inlet opening provided in the base plate 111, the individual spring elements 116, 117 being slipped on to the centre piece 112 and being secured in place by means of a lock nut 118 with the aid of the front and the rear spring plate 114, 115.

FIG. 1*b* shows the joint arrangement according to FIG. 1*a* known from the prior art in a state of compression in which compressive forces act on the draw bar 2 and therefore on the centre piece 112 of the draw/buffing gear 100 connected to the coach body end of the draw bar 2 and extending the draw bar 2 in its longitudinal direction. This compression causes the draw bar 2 or the centre piece 112 of the draw/buffing gear 100 to be displaced in the direction of the coach body together with the front spring plate 114 on the draw bar side, thereby reducing the distance between the front spring plate 114 and the base plate 11 connected to the coach body compared to the non-stressed state shown in FIG. 1*a*. The two elastomeric spring elements 116 arranged between the front spring plate 114 and the base plate 111 are compressed as a result of the action of the compressive forces, the compressive forces being directed in an absorbed manner via the compressed spring elements 116 on to the base plate 111 of the coach body. It will be clear from FIG. 1*b* that, in the state of compression, the distance between the end face of the base plate 111 on the coach body side and the rear spring plate 115 screwed tightly to the centre piece 12 of the draw/buffing gear 100 increases compared to the non-stressed state shown in FIG. 1*a*, the rear spring element 117 arranged between the base plate 111 and the rear spring plate 115 being brought into an unstressed state.

Hollow springs made of an elastomeric material are generally used as the spring elements in the draw/buffing gear 100 of the joint arrangement known from the prior art and shown by way of example in FIGS. 1*a* and 1*b*, the cross-sectional shapes of these hollow springs usually being circular due to the design. The spring elements 116, 117 in the draw/buffing gear 100 thus take on the function of absorbing the tractive and impact forces occurring when forces are transmitted from the draw bar 2 to the coach body. Another function consists in that some of the energy produced during the transmission offerees is dissipated in the spring elements 116, 117.

In the conventional solution as shown in FIGS. 1*a* and 1*b*, the centre piece 112 of the draw/buffing gear 110 is guided through the inlet opening provided in the base plate 111 connected to the coach body with the aid of a spherical liner arrangement 119. The centre piece 112 of the draw/buffing gear 100 and therefore also the draw bar 2 connected to the centre piece 112 are then at least partially supported in the inlet opening in the base plate 111 by means of the spherical liner arrangement 119.

In the joint arrangement known from the prior art shown in FIGS. 1*a* and 1*b*, the draw bar 2 or the centre piece 112 of the draw/buffing gear 100 connected to the draw bar 2 is moreover supported in a corresponding manner with the aid of a draw bar supporting device 120 provided to this end. This draw bar supporting device 120 can furthermore take on the function of recentring the draw bar 2 and therefore the centre piece 112 of the draw/buffing gear 100 connected to the draw bar 2.

In this generic joint arrangement, the spherical liner arrangement 119 already provides a solution for minimising the wear of the spring elements 116, 117 provided in the joint arrangement occurring during operation. A spherical liner arrangement 119 of this kind of course has a complicated design as a result of the partly extreme forces acting on the joint arrangement, as it has to be designed in an appropriate manner to meet the expected requirements. In particular, the angle of deflection of the draw bar that can be achieved with the conventional joint arrangement is limited to a relatively small range as a result of the way that the centre piece 112 is guided through the inlet opening provided in the base plate 111.

SUMMARY OF THE INVENTION

The aim of the invention is therefore to further develop a joint arrangement of the type mentioned at the outset in that, on the one hand, the joint arrangement overall has a simpler design, wherein premature wear of the spring elements provided in the joint arrangement can simultaneously be prevented in an optimum manner, and that, on the other hand, tractive and compressive forces can be transmitted from the draw bar to the coach body even in the case of large angles of deflection.

This problem is solved according to the invention in the case of a joint arrangement of the type mentioned at the outset in that the at least one front spring element and the at least one rear spring element positively surround the centre piece of the draw/buffing gear and are designed in such a manner that they are each supported in the vertical and in the horizontal direction against the edge of the inlet opening present in the base plate.

The solution according to the invention has a whole series of essential advantages over the joint arrangements known from the prior art and described hereinbefore. In particular, as a result of the fact that the front and the rear spring element positively surround the draw bar and are then supported against the base plate in the vertical and in the horizontal direction, these spring elements serve not only to absorb the tractive and impact forces transmitted by the joint arrangement, but moreover also take on the function of supporting the coupling rod within the inlet opening provided in the base plate. The spring elements furthermore take on the function of guiding the coupling rod in the inlet opening. Compared to the solutions known from the prior art, in the joint arrangement according to the invention, there is therefore no need for a complicated spherical liner arrangement or for other solutions which guide and support the coupling rod within the plate. The complexity of the design of the joint arrangement can therefore be reduced. In particular, by virtue of the solution according to the invention, it is also possible to dispense with a separate draw bar support.

The spring joint according to the invention therefore represents a simple variant for linking and support, the basic design of the spring joint being similar to the existing joint arrangements described at the outset in which elastomeric spring elements in the form of hollow rubber springs are used, the said spring elements essentially having circular cross sections in the centre piece and in the case of the hollow springs and primarily taking on the function of absorbing the tractive and impact forces transmitted by the joint arrangement. In particular, the basic design of the spring joint is composed of a screwed-on draw bar with spring plates, a front and a rear rubber element and a base plate against which the spring elements (rubber rings) are supported according to the invention. The solution according to the invention can therefore also be used in conventional couplings and joints for interconnecting coach bodies or complete trains by means of, e.g. an automatic coupling or tight coupling.

The main object of the invention consists of the transmission of tractive and impact forces or compressive forces occurring during operation. The joint arrangement is thus designed in such a manner that tractive and compressive forces are introduced into the system via the draw bar. The compressive forces are then transmitted to the base plate via the front spring plate and the adjacent spring element. Tractive forces are directed on to the base plate via the rear spring plate and the rear spring element. The base plate is screwed on to the underframe of the coach body so that the forces can be introduced into the underframe via the base plate. By virtue of the arrangement of the spring elements in the draw/buffing gear according to the invention, in particular, premature wear of the spring elements can also be prevented in an efficient manner. In particular, as a result of the fact that the spring elements are supported in the vertical and in the horizontal direction according to the invention, the spring elements can be subjected to almost uniform stress, even in the case of large angles of deflection. The solution according to the invention furthermore prevents direct contact between the centre piece and the bearing plate (i.e. the inner wall of the inlet opening provided in the base plate) during normal operation. Another advantage of the solution according to the invention is that a larger angle of deflection can be obtained than in the case of the conventional joint arrangements. This is achieved, in particular, in that the spring elements take on the function of supporting the coupling rod within the inlet opening.

Advantageous developments of the invention are specified in the dependent claims.

In a particularly preferred development, it is provided that respective recess regions extending at least partially along the respective periphery of the inlet opening provided in the base plate and having a shape matching the contour of the front or the rear spring element are provided in the end face of the base plate on the draw bar side and/or in the end face of the base plate on the coach body side, the respective spring element lying flush in the associated recess region and being supported against it. This is a preferred solution in order to allow the spring elements positively surrounding the draw bar to be supported against the base plate in the vertical and in the horizontal direction. In particular, it is provided that recess regions matching the contour of the adjacent spring element are provided a least on one end face of the base plate. The respective spring elements are pressed into these recess regions so that they bear flush against the walls of the recess region. Support can thus be provided for the spring elements and therefore for the draw bar positively surrounded by the spring elements in a particularly effective and thus efficient manner. In other words, the recess regions provided in the respective end faces of the base plate therefore form a seat for receiving the respective spring elements. During operation, the spring elements are components subjected to a great deal of stress. The contours of these spring elements and the adjacent base plate or of the recess regions provided in the respective end faces of the base plate into which the respective spring elements are pressed and lie flush should advantageously be designed, on the one hand, so as to ensure sufficient support, but, on the other hand, so as to provide sufficient space for the deformation of the elastomeric spring elements during compression or deflection.

In particular, it is an advantage of this preferred embodiment that the spring elements provided in the draw/buffing gear, on the one hand, allow the draw bar to be hidden and, on the other hand, simultaneously cause integrated resetting of the draw bar, given a suitable selection for the shape of the recess regions.

In a particularly preferred development of the embodiments already mentioned, it is provided that the shape of the cross section of the through opening provided in the base plate is designed so as to allow for horizontal swiveling of the centre piece of the draw/buffing gear extending through the through opening within a prescribed angular range, in particular through ±25°, and therefore for deflection of the draw bar connected to the centre piece about the Z-axis. In particular, the inlet opening through the base plate should be so large that deflections of the draw bar of up to ±25° about the Z-axis are possible. The base plate and the inlet opening provided therein are preferably designed in such a manner that the draw bar bears flat against the correspondingly designed contour of the base plate when full deflection has been achieved. As already mentioned previously, the contours of the spring elements and the adjacent base plate must be designed, on the one hand, so as to ensure sufficient support, but, on the other hand, so as to provide sufficient space for the deformation of the rubber elements during compression or deflection.

The term "Z-axis" refers to the axis extending vertically relative to the longitudinal direction of the draw bar.

In this specification, the term "X-axis" refers to the axis extending (horizontally) in the longitudinal direction of traction, the term "Y-axis" refers to the horizontal axis at right angles thereto and the term "Z-axis" refers to the axis extending vertically relative to the longitudinal direction of the draw bar.

As explained previously, providing the recess regions extending at least partially along the respective periphery of the inlet opening provided in the base plate on the end face of the base plate on the draw bar side or on the end face of the base plate on the coach body side in which the respective spring element lies flush provides support for the spring elements and therefore for the centre piece of the draw/buffing gear positively surrounded by the spring elements. As the centre piece supported in this manner is fastened to the coach body end of the draw bar, support is also provided for the draw bar in the Y-direction and in the Z-direction. In order to allow additionally for resetting about the X-axis, it is provided in a particularly preferred development of the last-mentioned embodiments that the at least one front spring element and/or the at least one rear spring element each have a cross-sectional shape differing from a circular shape, in particular an elliptical, oval or ellipse-like cross-sectional shape, at least at their respective pressure plate ends.

The term "ellipse-like cross-sectional shape" as used herein refers to a shape also including, e.g. an ellipse trimmed along its longitudinal extent so that the longitudinal sides of the ellipse trimmed in this manner extend parallel to one another. It is essential that the cross-sectional shape of the respective spring elements is not exactly circular, i.e. centrally symmetrical.

A spring element having a cross-sectional shape of this kind differing from a circular shape thus prevents the spring element from rotating relative to the base plate when the spring element bears flush against the base plate or lies flush in the recess regions provided in the respective end faces of the base plate. As a result of the fact that rotation of the spring elements relative to the base plate can be prevented in this manner, rotation of the centre piece of the draw/buffing gear against which the spring elements bear flush and therefore rotation of the draw bar connected to the centre piece at its coach body end are also prevented. However, other solutions are of course also conceivable here.

In a particularly preferred implementation of the last-mentioned embodiment, in which the at least one front spring element and/or the at least one rear spring element each have a cross-sectional shape differing from a circular shape at least at their respective pressure plate ends, an elliptical or ellipse-like cross-sectional shape with a horizontally extending major axis and a vertically extending semi-axis is provided for the spring elements. As already indicated previously, the term "ellipse-like cross-sectional shape" refers to a shape including, e.g. an ellipse trimmed along its longitudinal extent. In other words, the cross-sectional shapes of the respective spring elements can also be a rectangular shape, the respective opposing shorter sides of the rectangle being designed as semi-circles. This embodiment should of course be understood in such a manner that any cross-sectional shape is conceivable in order to allow for resetting of the centre piece of the draw/buffing gear about the X-axis with the aid of the shape of the spring element when the spring element bears flush against the base plate or lies flush in the recess regions provided in the end faces of the base plate.

In order, on the one hand, to prevent the draw bar or the centre piece of the draw/buffing gear from rotating relative to the spring elements in an effective manner and, on the other hand, to achieve resetting of the draw bar, it is provided in a particularly preferred development that the at least one front spring element and the at least one rear spring element each have a through hole, in particular a through hole arranged centrally in the respective spring elements, through which the centre piece of the draw/buffing gear extends, the through hole formed in the front spring element and/or the through hole formed in the rear spring element each having a cross-sectional shape differing from a circular shape, in particular, an elliptical, oval or ellipse-like cross-sectional shape. It is furthermore preferably provided that the centre piece of the draw/buffing gear has a cross-sectional shape corresponding to the respective through hole at least in the portions extending through the through hole formed in the front spring element and/or through the through hole formed in the rear spring element, where it bears flush against the inner contour of the corresponding through hole. The inner contour of the spring element and therefore also the outer contour of the centre piece are therefore, e.g. elliptical, oval or ellipse-like, as a result of which it is possible to prevent the centre piece and therefore the draw bar from rotating relative to the spring elements in a simple, but effective manner. This therefore also prevents substantial rotation of the draw bar relative to the base plate and resetting is achieved instead. Other shapes are of course also conceivable for the through holes formed in the respective spring elements and for the respective portions of the centre piece of the draw/buffing gear extending through the through holes formed in the spring elements. This shape should of course differ from an exact circular shape.

In a particularly preferred implementation of the last-mentioned embodiment, by means of which substantial rotation of the draw bar relative to the base plate can be prevented in an efficient manner, it is provided that the through hole formed in the front spring element and/or the through hole formed in the rear spring element each have an elliptical or ellipse-like cross-sectional shape with a horizontally extending major axis and a vertically extending semi-axis. This is one possible implementation, wherein the entire draw/buffing gear can be designed to be locked against rotation with the aid of the contour of the through holes. Other solutions are of course also conceivable here.

In another development albeit known partly from railway engineering, it is provided that the at least one front spring element and the at least one rear spring element are pretensioned between the respective spring plates and the base plate in the direction of traction/impact. The sequence of events taking place during the transmission of tractive and impact forces can therefore be set and prescribed precisely from the outset. In particular, it is possible to achieve zero-backlash actuation of the spring elements provided in the joint arrangement.

BRIEF DESCRIPTION OF THE DRAWINGS

One preferred embodiment of this invention will now be described in more detail with reference to the accompanying drawings, in which.

DETAILED DESCRIPTION OF AN ILLUSTRATIVE EMBODIMENT

Figure 1A:
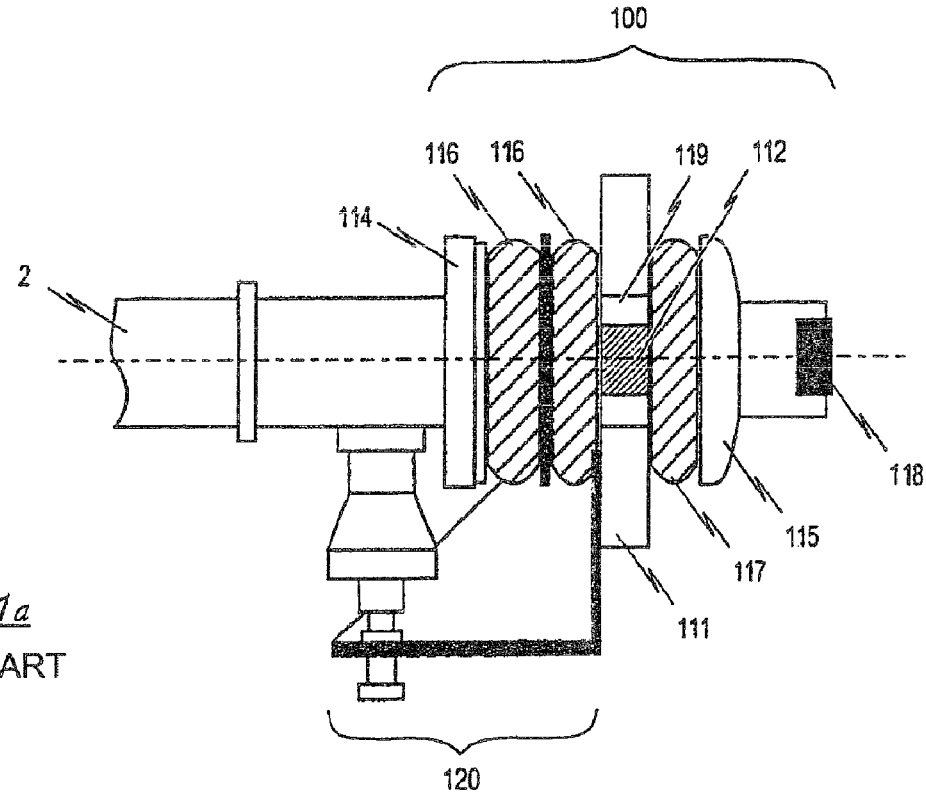
Fig. 1a PRIOR ART
FIG. 1*a* shows a joint arrangement known from the prior art for linking a draw bar to a coach body.

FIG. 1*a* shows a joint arrangement known from the prior art for linking a draw bar 2 to a coach body (not shown explicitly) of a rail vehicle. Draw/buffing gear 100 by means of which tractive and impact forces acting on the draw bar 2 are transmitted to a base plate 111 connected to the coach body is arranged at the coach body end of the draw bar 2. The other end (not shown) of the draw bar 2 is connected, e.g. to a coupling head (likewise not shown explicitly) for an automatic central buffer coupling.

In its basic design, the draw/buffing gear 100 consists of a centre piece 112 connected to the coach body end of the draw bar 2 and having a front spring plate 114 and a rear spring plate 115, the rear spring plate 115 being fastened to the coach body end of the centre piece 112 with the aid of a lock nut 118. In the embodiment of the joint arrangement known from the prior art shown in FIG. 1*a*, two elastomeric spring elements 116 are pretensioned between the front spring plate 114 and the pressure plate 111 rigidly connected to the underframe of the coach body. A rear elastomeric spring element 117 is provided between the base plate 111 and the rear spring plate 115. The spring elements 116, 117 are hollow rubber springs with a circular cross section. In the draw/buffing gear 100, they take on the function of absorbing the tractive and impact forces occurring during the transmission of forces, so that the forces absorbed can then be transmitted from the draw bar 2 via the pressure plate 111 into the underframe of the vehicle (not shown explicitly).

The embodiment shown in FIG. 1*a* is what is referred to as a doughnut solution, in which the elastomeric spring elements 116, 117 are similar to a doughnut, the through opening arranged centrally in the respective spring elements 116, 117 having a circular cross-sectional shape. The centre piece 112 of the draw/buffing gear 100 extends through this through opening, which cannot be seen in FIG. 1*a*. The centre piece 112 furthermore extends through an inlet opening provided in the base plate 111. A spherical liner arrangement 119 is required in order to ensure that the centre piece 112 is supported and guided in the inlet opening, thereby complicating the overall design of the joint arrangement. A support 120 is furthermore provided in order to support the centre piece 112 or the draw bar 2 connected to the centre piece 112 in the vertical direction.

Figure 1B:
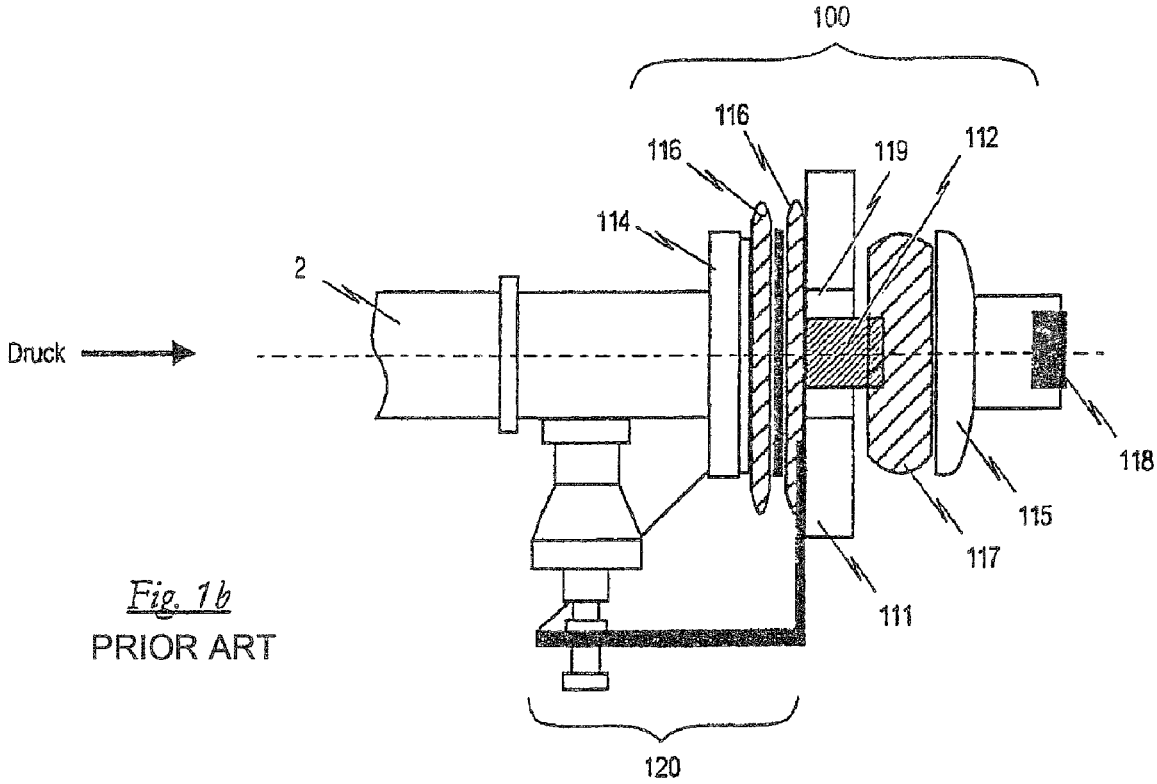
Fig. 1b PRIOR ART
FIG. 1*b* shows the conventional joint arrangement shown in FIG. 1*a* under compressive stress.

FIG. 1*b* shows the joint arrangement according to FIG. 1*a* known from the prior art and described hereinbefore in a state of compression, i.e. in a state in which compressive forces are transmitted from the draw bar 2 to the draw/buffing gear 100 and in an absorbed manner to the base plate 111. The front spring elements 116 are deformed in a corresponding manner in the state shown in FIG. 1*b*, while the rear spring element 117 is in an unstressed state.

The problems encountered with the joint arrangement known from the prior art, particularly in view of the hollow rubber springs used as the spring elements and in view of the spherical liner arrangement used to support and guide the centre piece of the draw/buffing gear in the inlet opening have already been described and do not have to be discussed again here.

Figure 2:
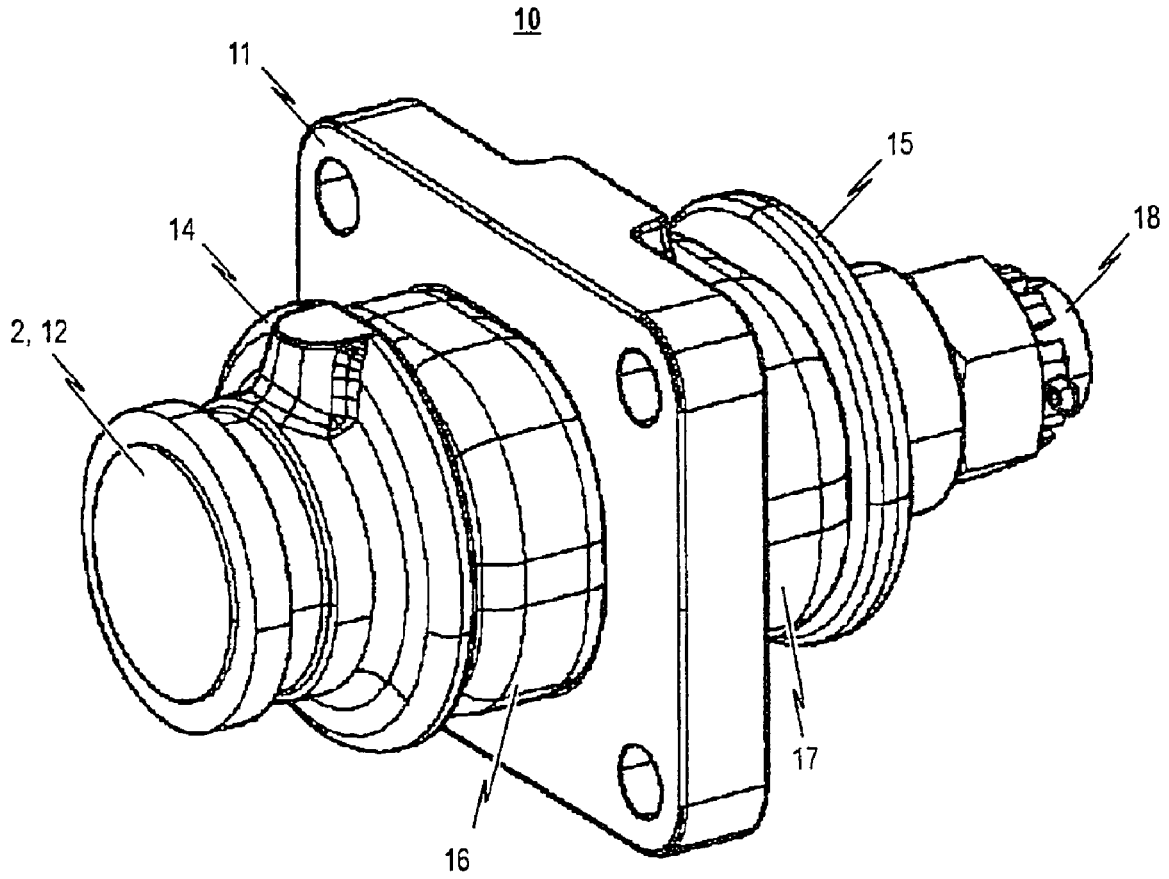
FIG. 2 is a perspective overall view of a preferred embodiment of the joint arrangement according to the invention.

FIG. 2 is a perspective side view showing a preferred embodiment of the joint arrangement according to the invention. The joint arrangement of this embodiment has draw/buffing gear 10 in order to transmit tractive and compressive forces or impact forces acting on a draw bar 2 (not shown explicitly) to a base plate 11 connected to a coach body (likewise not shown). The draw/buffing gear 10 is provided to this end with a centre piece 12 connected to the coach body end of the draw bar 2 and extending the draw bar 2 in its longitudinal direction, and can be seen as such at the draw bar end of the draw/buffing gear 10 in the perspective side view of FIG. 2.

A front elastomeric spring element 16 on the draw bar side is clamped between a front spring plate 14 on the draw bar side and the pressure plate 11 and an elastomeric spring element 17 on the coach body side is clamped between the pressure plate 11 and a rear spring plate 15 in order to absorb the tractive and compressive forces occurring during operation and acting on the draw bar 2 and therefore on the centre piece 12 of the draw/buffing gear 10 connected to the draw bar 2. The rear spring plate 15 is fixed to the centre piece 12 with the aid of a lock nut 18, the lock nut 18 being mounted in a corresponding manner at the coach body end of the centre piece 12.

Figure 3:
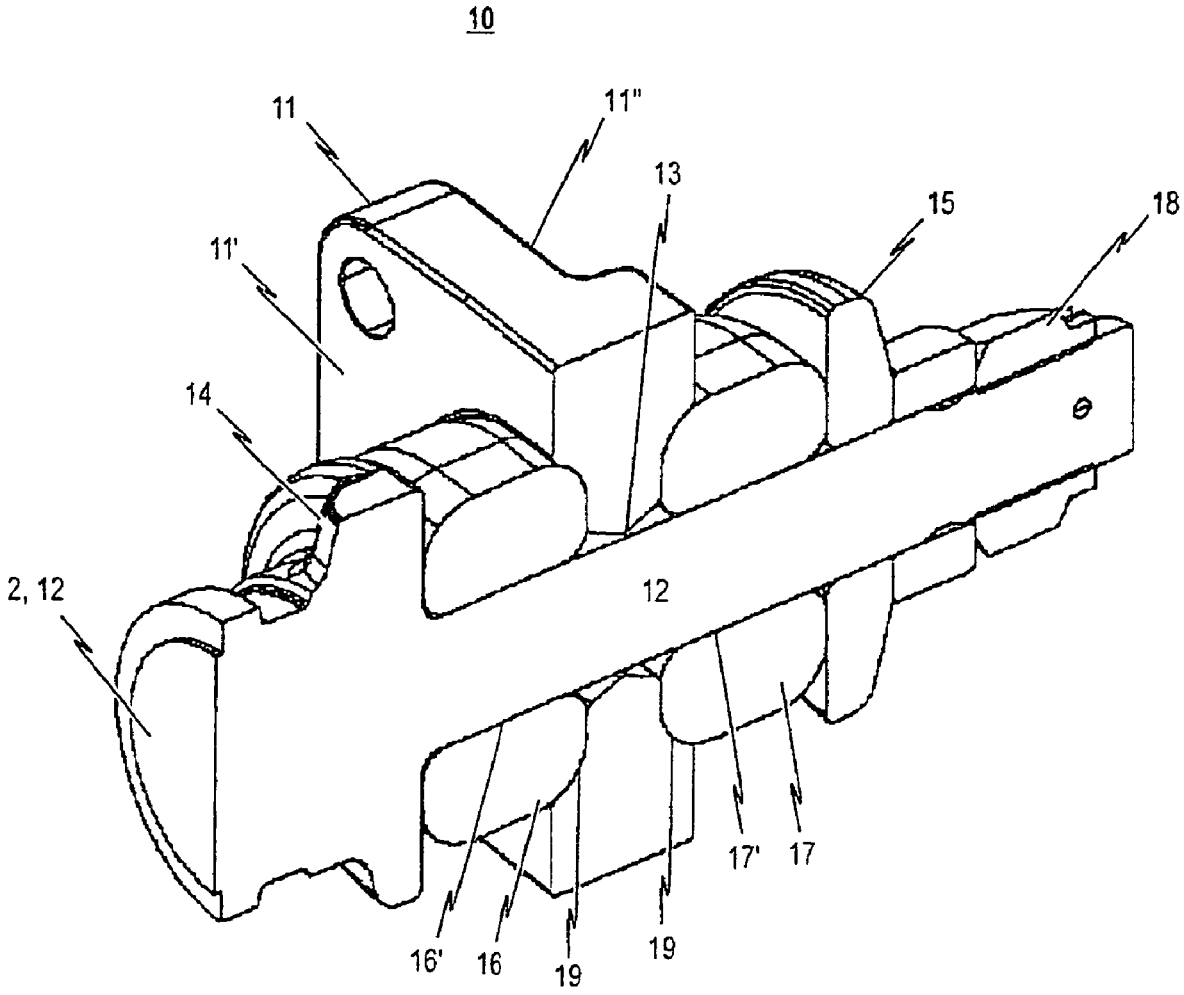
FIG. 3 is a perspective view of a longitudinal section of the joint arrangement shown in FIG. 2.

FIG. 3 is a perspective cross-sectional view showing the joint arrangement shown in FIG. 2. This view clearly shows the shape of the centre piece 12 of the draw/buffing gear 10. In particular, the centre piece 12 extends in sequence from its draw bar end to its coach body end through a through hole 16' arranged centrally in the front spring element 16, an inlet opening 13 provided in the base plate 11, a through hole 17' arranged centrally in the rear spring element 17, and through the rear spring plate 15 and the lock nut 18 which is slipped on to the coach body end of the centre piece 12 and fixes the rear spring plate 15 and simultaneously pretensions the front and the rear spring element 16, 17 in a corresponding manner. In the preferred embodiment shown, the front spring plate 14 is formed in one piece with the centre piece 12 in the form of a flange-like projection. However, it is of course also conceivable here for the front spring plate 14, like the rear spring plate 15, to be slipped on to the centre piece 12 as a separate component and fixed at a suitable point in a corresponding manner.

The centre piece 12 bears positively against the respective spring elements 16, 17 in the through holes 16', 17' provided in the front spring element 16 and in the rear spring element 17. The spring elements 16, 17 themselves lie flush in respective recess regions 19 provided in the end face 11' of the base plate 11 on the draw bar side or in the end face 11" of the base plate 11 on the coach body side. This ensures that the centre piece 12 of the draw/buffing gear 10 is supported against the base plate 11 in the vertical and in the horizontal direction with the aid of the spring elements 16, 17. In particular, in the solution according to the invention, there is no longer any need to provide a corresponding support and/or guide in the form, e.g. of a complicated spherical liner arrangement in the inlet opening 13 provided in the base plate 11.

Figure 4A:
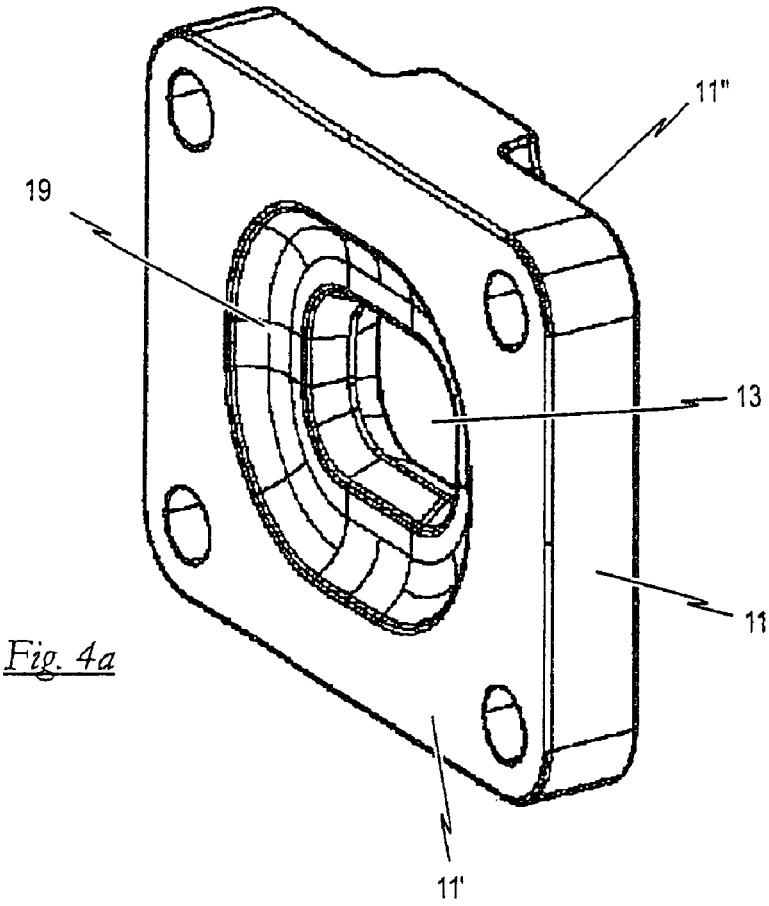
FIG. 4*a* is a perspective view of a base plate used in the joint arrangement according to FIG. 2.
Figure 4B:
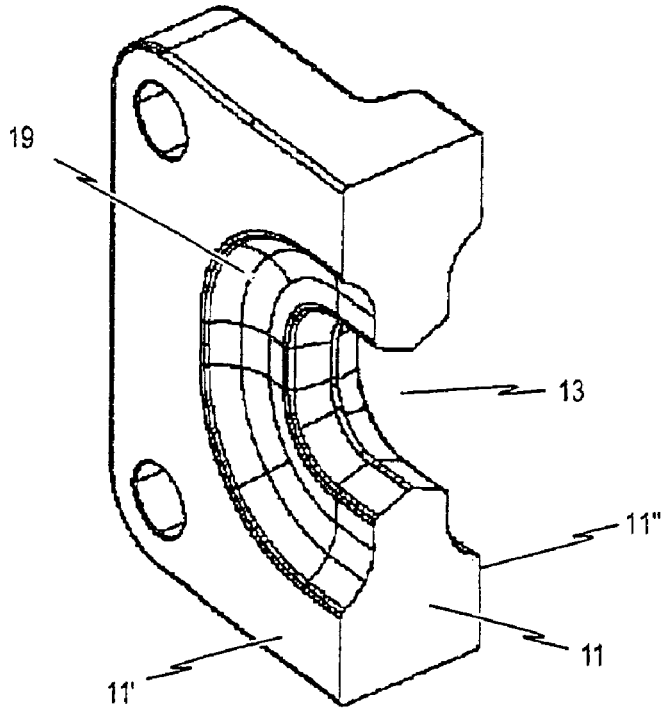
FIG. 4*b* is a perspective sectional view of the base plate shown in FIG. 4*a;*

FIG. 4*a* is a perspective detail view showing the base plate 11 used in the draw/buffing gear 10 according to FIG. 2. FIG. 4*b* is a sectional view showing the base plate 11 according to FIG. 4*a*. As already indicated, the base plate 11 has a preferably centrally arranged inlet opening 13 through which the centre piece not shown explicitly in FIGS. 4*a* and 4*b* extends in the assembled state of the draw/buffing gear 10. Respective recess regions 19 extending at least partially along the respective periphery of the inlet opening 13 provided in the base plate 11 are furthermore provided in the end face 11' of the base plate 11 on the draw bar side and in the end face 11" of the base plate 11 on the coach body side. As an alternative to the embodiment of the base plate 11 shown, it is of course also conceivable for only one of the two end faces 11', 11" of the base plate 11 to have a recess region 19 of this kind.

The recess region 19 has a shape matching the contour of the front or the rear spring element 16, 17 (not shown explicitly in FIGS. 4*a* and 4*b*), the respective spring element 16, 17 being pressed into the associated recess region 19 where it bears flush against the walls of the recess region 19 in the assembled state of the draw/buffing gear 10.

The inlet opening 13 provided in the base plate 11 and the recess regions 19 extending along the periphery of the inlet opening 13 each have a cross-sectional shape differing from a(n exact) circular shape. In particular, an oval, elliptical or ellipse-like cross-sectional shape is preferred. The cross-sectional shape of the inlet opening 13 shown in FIGS. 4*a* and 4*b* is a cross-sectional shape referred to in this specification as "ellipse-like". In particular, the horizontal extent of the cross-sectional shape is greater than the vertical extent thereof. The spring elements 16, 17 (not shown explicitly in FIGS. 4*a* and 4*b*) bearing flush against the respective walls of the recess regions 19 are supported in the Y-direction and in the Z-direction by means of the recesses 19 in the base plate 11.

As these spring elements 16, 17 positively surround the centre piece 12 of the draw/buffing gear 10, as described in connection with FIG. 3, corresponding support can also be achieved for the centre piece 12 or for the draw bar 2 connected to the centre piece 12 as a result of the fact that the spring elements 16, 17 lie flush in the respective recess regions 19.

Figure 5:
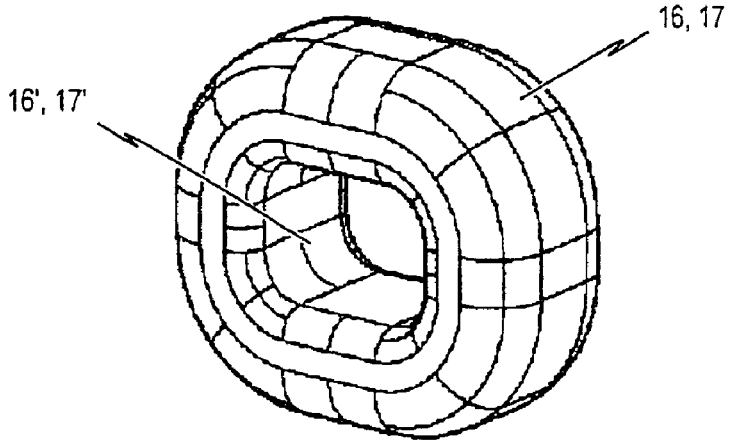
FIG. 5 is a perspective view of a spring element used in the draw/buffing gear of the joint arrangement shown in FIG. 2.

FIG. 5 is a perspective view of a spring element 16, 17 which can be integrated either as a front or as a rear spring element into the draw/buffing gear 10 of the preferred embodiment according to FIG. 2. The spring element 16, 17 shown has an ellipse-like outer contour corresponding to the contour of the recess region 19 provided in the base plate 11 (cf. FIGS. 4*a* and 4*b*) in order to ensure that the spring elements 16, 17 are supported against the base plate 11 in the Y-direction and in the Z-direction with the aid of the recess regions 19. Using an ellipse-like spring element, which may of course also be a spring element with an oval or elliptical contour, also allows for resetting of the centre piece and therefore of the draw bar about the X-axis in addition to the support described previously. This cannot be achieved in the case of conventional draw/buffing gear, as the spring elements used therein are generally designed as hollow rubber springs with a circular cross section.

As already mentioned in connection with FIGS. 1*a* and 1*b*, in the draw/buffing gear known from the prior art, the corresponding support and resetting of the centre piece are achieved with the aid of suitable supporting arrangements.

It can furthermore be deduced from FIG. 5 that the spring element 16, 17 has a preferably centrally arranged through hole 16', 17' through which the centre piece 12 of the draw/buffing gear 10 extends in the assembled state, those portions A of the centre piece 12 passing through the through hole 16', 17' provided in the spring element 16, 17 bearing positively against the respective inner walls of the opening 16', 17'. This is shown, in particular, in FIG. 3.

The through hole 16', 17' formed in the spring element 16, 17 preferably has a cross-sectional shape differing from a circular shape. According to FIG. 5, it has an ellipse-like shape with a horizontally extending major axis and a vertically extending semi-axis. The portions A of the centre piece 12 of the draw/buffing gear 10 extending through the through hole 16', 17' formed in the spring element 16, 17 and having a cross-sectional shape of this kind differing from a(n exact) circular shape thus have a cross-sectional shape corresponding to the through hole 16', 17' so that they bear flush against the inner contour of the through hole 16', 17'. This corresponding cross-sectional shape of the portions A can be seen in FIG. 6.

In FIG. 5, the inner contour of the spring element 16, 17 is ellipse-like. The outer contour of the corresponding portions A of the centre piece 10 is consequently also ellipse-like so that rotation of the centre piece 12 relative to the spring elements 16, 17 and therefore rotation of the draw bar 2 relative to the spring elements 16, 17 can be prevented in an effective manner. In particular, substantial rotation of the draw bar 2 relative to the base plate 11 can therefore be prevented, with resetting being achieved instead.

Figure 6:
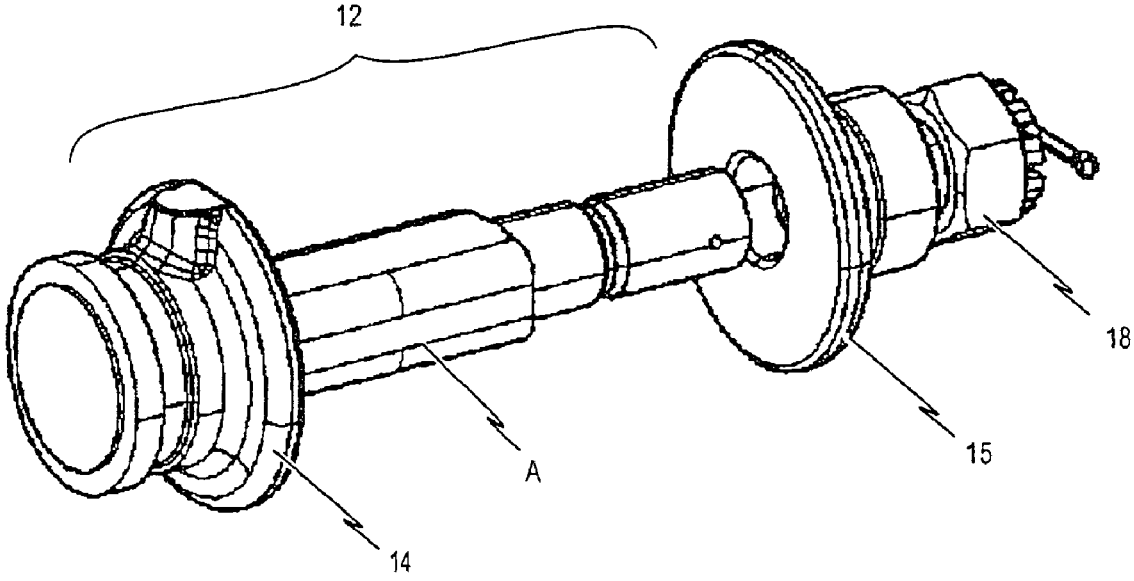
FIG. 6 is an exploded view of a centre piece of draw/buffing gear used, e.g. in the joint arrangement shown in FIG. 2.

FIG. 6 is an exploded view showing the centre piece 12 used in the draw/buffing gear 10 according to FIG. 2. The centre piece 12 consists of the front spring plate 14, the rear spring plate 15 and the lock nut 18, the rear spring plate 15 being slipped on to the centre piece and being fixed in a corresponding manner to the coach body end of the centre piece 12 with the aid of the lock nut 18. The individual spring elements 16, 17 (cf. FIG. 5) are not shown in FIG. 6. In the assembled state, they would be arranged pretensioned between the front spring plate 14, the base plate 11 rigidly connected to the underframe of the coach body, and the rear spring plate 15.

As already mentioned in connection with FIG. 3, in the embodiment of the centre piece 12 shown in FIG. 6, the front spring plate 14 is formed in one piece with the centre piece 12. The portions A of the centre piece 12 extending through the through openings 16', 17' provided in the spring elements 16, 17 are situated between the front spring plate 14 and the rear spring plate 15.

In the preferred embodiment of FIG. 2, the through holes 16', 17' of the spring elements 16, 17 are ellipse-like, as already described in connection with FIG. 5, so that the corresponding portions A of the centre piece 12 extending through the through hole 16' formed in the front spring element 16 and through the through hole 17' formed in the rear spring element 17 have a cross-sectional shape corresponding to the respective through hole 16', 17', in this case an ellipse-like shape. However, it is of course also conceivable for only those portions A of the centre piece 12 extending either through the through hole 16' formed in the front spring element 16 or through the through hole 17' formed in the rear spring element 17 to have the outer contour corresponding to the inner contour of the respective through hole 16', 17'.

The centre piece 12 of the draw/buffing gear 10 is designed, e.g. as an individual casting, as a result of the required ellipse-like contour of the respective portions, the front spring plate 14 being integrated directly into the centre piece 12. However, other methods of producing the centre piece 12 are of course also conceivable.

The draw/buffing gear is assembled in an analogous manner to the existing doughnut variants (cf. FIGS. 1*a* and 1*b*). The spring elements 16, 17 and the base plate 11 are slipped on to the centre piece 12 of the draw/buffing gear 10 and are secured in place with the aid of the spring plates 14, 15 and by means of a lock nut 18.

Figure 7A:
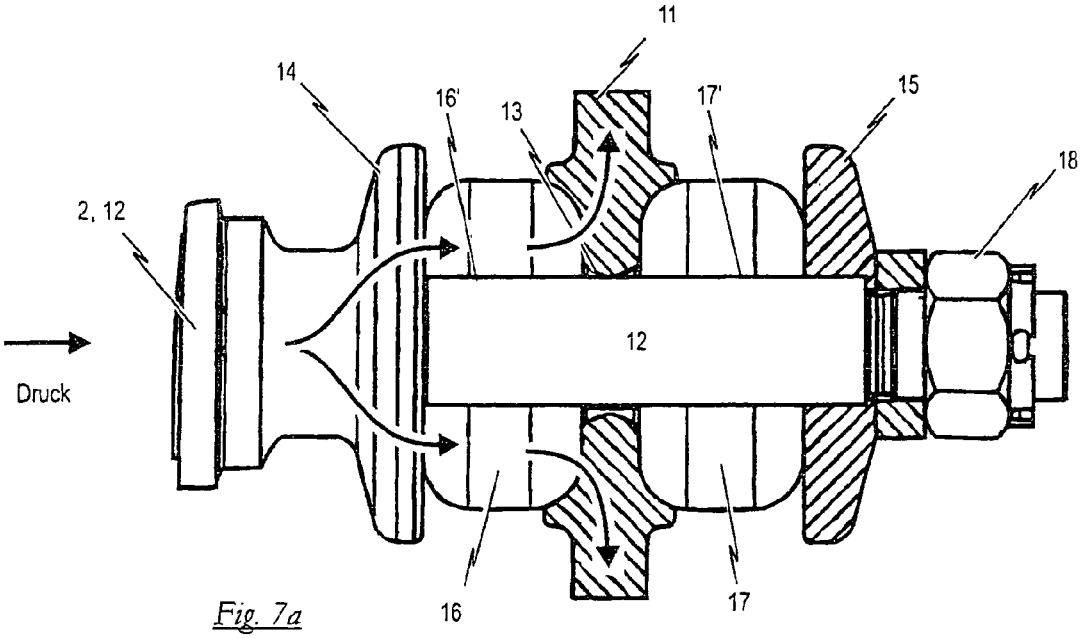
FIG. 7*a* is a cross-sectional view of the joint arrangement shown in FIG. 2 in order to illustrate the distribution of forces within the draw/buffing gear when it is under compressive stress.
Figure 7B:
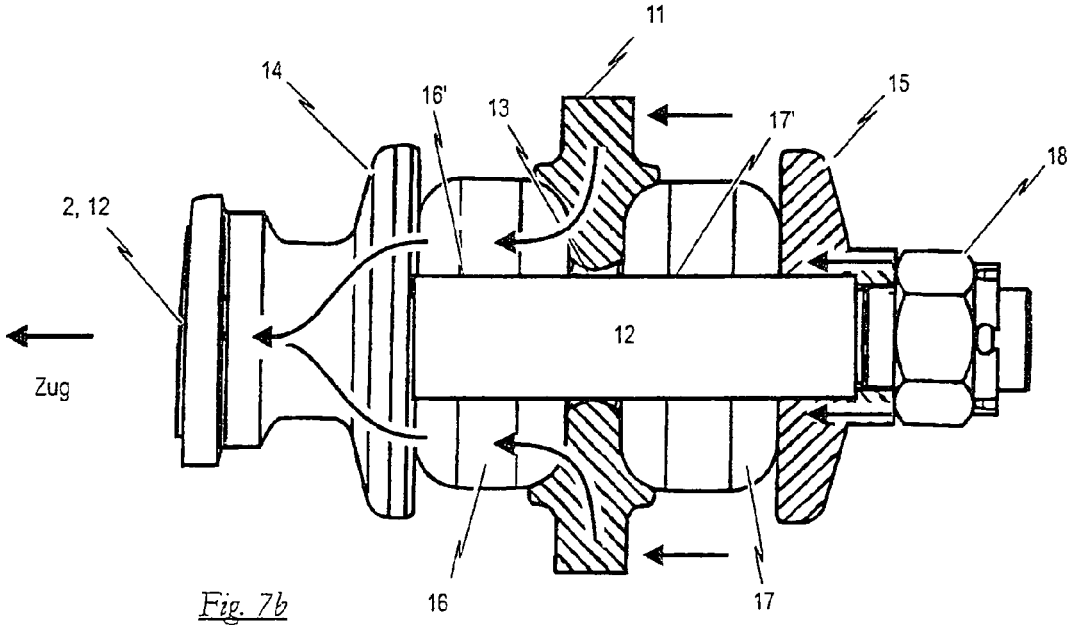
FIG. 7*b* is a cross-sectional view of the joint arrangement shown in FIG. 2 in order to illustrate the distribution of forces within the draw/buffing gear when it is under tensile stress.

FIG. 7*a* is a cross-sectional view of the joint arrangement shown in FIG. 2 in order to illustrate the distribution of forces within the draw/buffing gear when it is under compressive stress. FIG. 7*b* is a cross-sectional view of the joint arrangement shown in FIG. 2 in order to illustrate the distribution of forces within the draw/buffing gear when it is under tensile stress.

The main object of the draw/buffing gear 10 consists of the transmission of tractive and compressive forces occurring during operation and acting on the draw bar 2. The tractive and compressive forces are thus introduced into the system via the draw bar 2 connected to the centre piece 12 of the draw/buffing gear 10 at its coach body end. The compressive forces are transmitted to the base plate 11 via the front spring plate 14 and the adjacent front spring plate 16 (FIG. 7*a*). The tractive forces are directed on to the base plate 11 via the rear spring plate 15 and the rear spring element 17 (FIG. 7*b*). The base plate 11 is screwed on to the underframe of the coach body (not shown explicitly) so that the forces can be introduced into the underframe.

Figure 8:
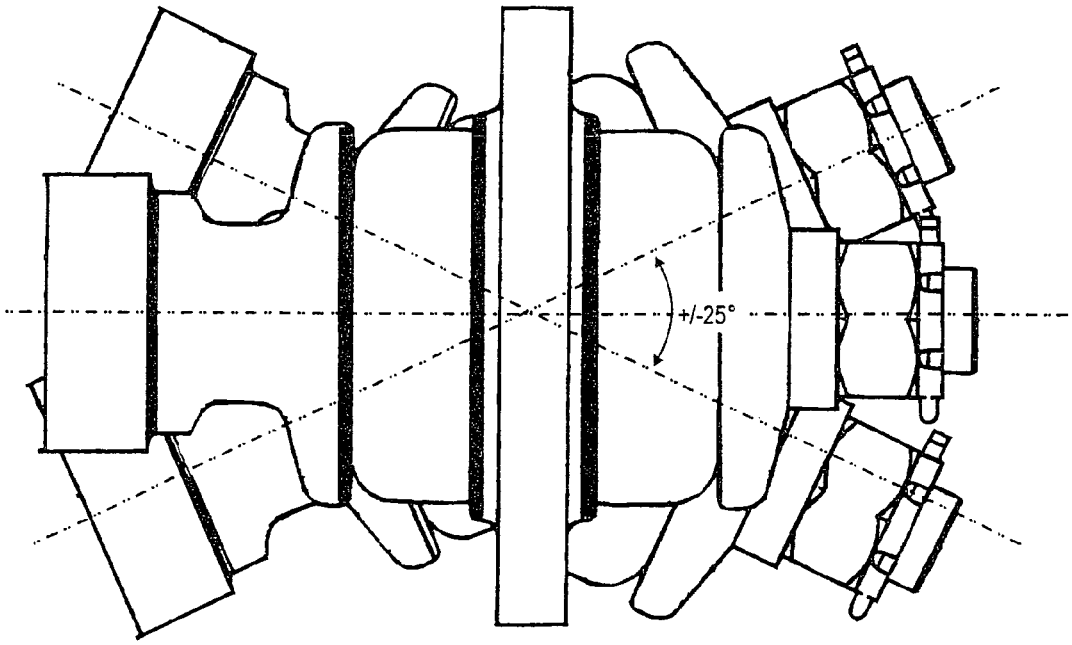
FIG. 8 is a cross-sectional view of the joint arrangement shown in FIG. 2 in order to illustrate the possible deflection range of the draw bar.

FIG. 8 is a top view showing the joint arrangement according to FIG. 2. The deflection range of the draw bar 2 about the Z-axis is shown in this top view, in this case ±25°. The inlet opening 13 through the base plate 11 must be dimensioned accordingly to this end to allow for deflection of the draw bar 2 or of the centre piece 12 within a deflection range which can be prescribed from the outset. If full deflection of the draw bar 2 or of the centre piece 12 has been achieved, the draw bar 2 bears flat against the correspondingly designed contour of the base plate 11.

In the preferred embodiment of the joint arrangement according to the invention shown in the figures, deflection and support are realised in the manner described hereinbefore. The spring parts 16, 17 integrated into the draw/buffing gear 100 are therefore components subjected to a great deal of stress. The contours of these spring parts 16, 17 and of the adjacent base plate 11 are advantageously designed, on the one hand, so as to ensure sufficient support, but, on the other hand, so as to provide sufficient space for the deformation of the elastomeric spring elements during compression or deflection.

It should be pointed out that the implementation of the invention is not limited to the embodiment described in the figures, but is also possible in a plurality of variants.

The invention claimed is:

1. A joint arrangement for linking a draw bar to a coach body, comprising a base plate connected to the coach body, the base plate having an inlet opening; and a draw/buffing gear arranged at the coach body end of the draw bar for transmitting tractive and impact forces acting on the draw bar to the base plate, the draw/buffing gear having a centre piece connected to the coach body end of the draw bar and extending the draw bar in its longitudinal direction, the said centre piece extending through the inlet opening in the base plate and having a front spring plate on the draw bar side and a rear spring plate on the coach body side, at least one front spring element of resilient material arranged between the front spring plate and the base plate in the longitudinal direction of the draw bar, at least one rear spring element of resilient material arranged between the base plate and the rear spring plate in a longitudinal direction of the draw bar in order to absorb the tractive and impact forces to be transmitted, the at least one front spring element and the at least one rear spring element positively surrounding the centre piece of the draw/buffing gear and each being supported in the vertical and in the horizontal direction against the edge of the inlet opening in the base plate the base plate including respective recess regions provided in an end face on the draw bar side and/or in an end face on the coach body side extending at least partially along the respective peripheries of the inlet opening provided in the base plate and having shapes matching contours of the front and/or the rear spring element, the respective front and rear spring elements lying flush in the associated recess regions and being supported against the recess regions.

2. The joint arrangement according to claim 1 wherein the shape of a cross section of the inlet opening provided in the base plate is designed so as to allow for horizontal swiveling of the centre piece of the draw/buffing gear extending through the inlet opening within a prescribed angular range, for deflection of the draw bar connected to the centre piece about the Z-axis.

3. The joint arrangement according to claim 1, wherein the at least one front spring element and/or the at least one rear spring element each have an elliptical, oval, ellipse-like or similar cross-sectional shape at least at their respective pressure plate ends.

4. The joint arrangement according to claim 3, wherein the at least one front spring element and/or the at least one rear spring element each have an elliptical or ellipse-like cross-sectional shape with a horizontally extending major axis and a vertically extending semi-axis at their respective pressure plate ends.

5. The joint arrangement according to claim 1 wherein the at least one front spring element and the at least one rear spring element each have a through hole, through which the centre piece of the draw/buffing gear extends, the through hole formed in the front spring element and/or the through hole formed in the rear spring element each having an elliptical, oval, ellipse-like or similar cross-sectional shape, and the centre piece of the draw/buffing gear has a cross-sectional shape corresponding to the respective through hole at least in the portions extending through the through hole formed in the front spring element and/or through the through hole formed in the rear spring element, whereby the portions bearing flush against an inner contour of the through hole.

6. The joint arrangement according to claim 5, wherein the through hole formed in the front spring element and/or the through hole formed in the rear spring element each have an elliptical or ellipse-like cross-sectional shape with a horizontally extending major axis and a vertically extending semi-axis.

7. The joint arrangement according to claim 6 wherein the at least one front spring element and the at least one rear spring element are pretensioned between the respective spring plates and the base plate in the direction of traction/impact.

8. The joint arrangement of claim 2 wherein the prescribed angular range is ±25°.

9. The joint arrangement of claim 5 wherein each through hole is centrally arranged in said at least one front spring and/or said at least one rear spring.

10. The joint arrangement according to claim 1 wherein the shape of a cross section of the inlet opening provided in the base plate is designed so as to allow for horizontal swiveling of the centre piece of the draw/buffing gear extending through the inlet opening within a prescribed angular range, for deflection of the draw bar connected to the centre piece about the Z-axis.

11. The joint arrangement according to claim 10, wherein the at least one front spring element and/or the at least one rear spring element each have an elliptical, oval, ellipse-like or similar cross-sectional shape at least at their respective pressure plate ends.

12. The joint arrangement according to claim 11, wherein the at least one front spring element and/or the at least one rear spring element each have an elliptical or ellipse-like cross-sectional shape with a horizontally extending major axis and a vertically extending semi-axis at their respective pressure plate ends.

13. The joint arrangement according to claim 1 wherein the at least one front spring element and the at least one rear spring element each have a through hole, through which the centre piece of the draw/buffing gear extends, the through hole formed in the front spring element and/or the through hole formed in the rear spring element each having an elliptical, oval, ellipse-like or similar cross-sectional shape, and the centre piece of the draw/buffing gear has a cross-sectional shape corresponding to the respective through hole at least in the portions extending through the through hole formed in the front spring element and/or through the through hole formed in the rear spring element, whereby the portions bearing flush against an inner contour of the through hole.

14. The joint arrangement according to claim 13, wherein the through hole formed in the front spring element and/or the through hole formed in the rear spring element each have an elliptical or ellipse-like cross-sectional shape with a horizontally extending major axis and a vertically extending semi-axis.

15. The joint arrangement according to claim 12 wherein the at least one front spring element and the at least one rear spring element are pretensioned between the respective spring plates and the base plate in the direction of traction/impact.

16. The joint arrangement according to claim 2 wherein the at least one front spring element and the at least one rear spring element each have a through hole, through which the centre piece of the draw/buffing gear extends, the through hole formed in the front spring element and/or the through hole formed in the rear spring element each having an elliptical, oval, ellipse-like or similar cross-sectional shape, and the centre piece of the draw/buffing gear has a cross-sectional shape corresponding to the respective through hole at least in the portions extending through the through hole formed in the front spring element and/or through the through hole formed in the rear spring element, whereby the portions bearing flush against an inner contour of the through hole.

17. The joint arrangement according to claim 16, wherein the through hole formed in the front spring element and/or the through hole formed in the rear spring element each have an elliptical or ellipse-like cross-sectional shape with a horizontally extending major axis and a vertically extending semi-axis.

18. The joint arrangement according to claim 17 wherein the at least one front spring element and the at least one rear spring element are pretensioned between the respective spring plates and the base plate in the direction of traction/impact.

* * * * *

UNITED STATES PATENT AND TRADEMARK OFFICE

CERTIFICATE OF CORRECTION

PATENT NO. : 7,837,047 B2
APPLICATION NO. : 12/084079
DATED : November 23, 2010
INVENTOR(S) : Reiner Krause It is certified that error appears in the above-identified patent and that said Letters Patent is hereby corrected as shown below:

On page 1 of the patent, the Inventor's name misspelled as "Rainer Krause", should be --Reiner Krause--;

On page 1 of the patent, the Assignee's name misspelled as "Voith Torbo Scharfenberg GmbH & Co. KG", should be --Voith Turbo Scharfenberg GmbH & Co. KG--.

Signed and Sealed this
Twenty-second Day of March, 2011

David J. Kappos

David J. Kappos
*Director of the United States Patent and Trademark Office*